United States Patent [19]

Romanauskas

[11] 4,353,795

[45] Oct. 12, 1982

[54] FIELD FLOW FRACTIONATION CHANNEL

[75] Inventor: William A. Romanauskas, Southbury, Conn.

[73] Assignee: E. I. Du Pont de Nemours and Company, Wilmington, Del.

[21] Appl. No.: 249,963

[22] Filed: Apr. 1, 1981

[51] Int. Cl.[3] ..... B03B 5/62

[52] U.S. Cl. ..... 209/155; 73/432 PS; 233/27

[58] Field of Search ..... 209/1, 11, 155, 208, 209/444, 453; 55/67, 81; 73/23.1, 432 PS, 460, 461, 468; 210/72, 198.3; 233/1 R, 1 A, 1 D, 14 R, 23 R, 25, 26, 27

[56] References Cited

U.S. PATENT DOCUMENTS

| | | | |
|---|---|---|---|
| 4,283,276 | 8/1981 | Grant | 209/155 |
| 4,284,497 | 8/1981 | Grant | 209/155 |
| 4,285,809 | 8/1981 | Dilks et al. | 209/155 |

*Primary Examiner*—Ralph J. Hill

[57] ABSTRACT

A sedimentation field flow fractionation channel is constructed to have an outer support ring and a continuous inner channel ring mating with the support ring to define the channel. The channel ring has a tension modulus capable of following centrifugally induced expansions of the support ring. The channel ring is weight loaded to facilitate its following support ring expansions.

10 Claims, 5 Drawing Figures

FIELD FLOW FRACTIONATION CHANNEL

CROSS-REFERENCE TO RELATED APPLICATIONS

This application is related to inventions described in U.S. Pat. No. 4,283,276 issued Aug. 11, 1981 and entitled "Rotor for Sedimentation Field Flow Fractionation" by John Wallace Grant, copending applications Ser. No. 249,956 filed Apr. 1, 1981 and entitled "Centrifugal Oil Pump," by W. A. Romanauskas (IP-0261), Ser. No. 249,961, filed Apr. 1, 1981, and entitled "Rotating Seal for Centrifuges" by W. A. Romanauskas (IP-0262), and Ser. No. 249,962 filed Apr. 1, 1981 and entitled "Unbalanced Rotor for Field Flow Fractionation Channel" by W. A. Romanauskas (IP-0300).

BACKGROUND OF THE INVENTION

Sedimentation field flow fractionation is a versatile technique for the high resolution separation of a wide variety of particulates suspended in a fluid medium. The particulates include macromolecules in the $10^5$ to the $10^{13}$ molecular weight (0.001 to 1 μm) range, colloids, particles, micelles, organelles and the like. The technique is more explicitly described in U.S. Pat. No. 3,449,938, issued June 17, 1969 to John C. Giddings and U.S. Pat. No. 3,523,610, issued Aug. 11, 1970 to Edward M. Purcell and Howard C. Berg.

Field flow fractionation is the result of the differential migration rate of sample components in a carrier or mobile phase in a manner similar to that experienced in chromatography. However, in field flow fractionation there is no separate stationary phase as there is in the case of chromatography. Sample retention is caused by the redistribution of sample components between the fast and the slow moving strata within the mobile phase. Thus, particulates elute more slowly than the solvent front.

Typically a field flow fractionation channel consists of two closely spaced parallel surfaces. A mobile phase is caused to flow continuously through the gap between the surfaces. Because of the narrowness of this gap or channel (typically 0.025 centimeters (cm)) the mobile phase flow is laminar with a characteristic parabolic velocity profile. The flow velocity is the highest at the middle of the channel and essentially zero near the two channel surfaces. An external force field of some type (the force fields include gravitational, thermal, electrical, fluid cross flow and others described variously by Giddings and Berg and Purcell), is applied transversely (perpendicular) to the channel surfaces or walls. This force field pushes the sample components in the direction of the slower moving strata near the outer wall. The buildup of sample concentration near the wall, however, is resisted by the normal diffusion of the particulates in a direction opposite to the force field. This results in a dynamic layer of component particles, each component with an exponential—concentration profile. The extent of retention is determined by the particulates time average position within the concentration profile which position is a function of the balance between the applied field strength and the opposing tendency of particles to diffuse.

In the case of a sedimentation force field, which is used in sedimentation field flow fractionation (SFFF), use is made of a centrifuge. A thin annular belt-like channel is made to rotate about the axis of the annulus. The resultant centrifugal force causes sample components of higher density than the mobile phase to sediment toward the outer wall of the channel. For equal particle density, because of their higher diffusion rate, smaller particulates will accumulate into a thicker layer against the outer wall than will larger particulates. On the average, therefore, larger particulates are forced closer to the outer wall.

If now the mobile phase or solvent is fed continuously from one end of the channel, it carries the sample components through the channel for later detection at the outlet of the channel. Because of the shape of the laminar velocity profile within the channel and the placement of particulates in that profile, solvent flow causes smaller particulates to elute first, followed by a continuous elution of components in the order of ascending particulate mass.

There are many criteria that a channel should meet in order to reduce the separation times required using this technique. One such criteria is that the channel must be relatively thin. Unfortunately, this creates many problems in that the walls of the channel should have a microscopically smooth finish to prevent the particles from sticking to the walls or being trapped in wall crevices. To provide such a microfinish, it is desirable to have access to the interior of the channel. Further, one must have access to the inner walls of the channel on occasion for cleaning. In order to maintain a high degree of resolution of the separated components of the sample, the thickness of the channel should be maintained constant during centrifugation. Constant channel thickness is difficult to maintain during centrifugation because the outer channel wall tends to enlarge to a greater extent then the inner channel wall. This is particularly true when the channel is formed between mating inner and outer rings. This is not easily accomplished, particularly if the weight of the channel elements are to be maintained at reasonably small values as is desired in centrifugation.

Grant, in his application, describes a channel construction which overcomes many of these disadvantages. The Grant channel is formed in a long, thin annular belt-like configuration. The channel is designed to maintain its thickness dimension constant and yet facilitate its manufacturing and cleaning by forming the channel of double mating rings in which the inner ring is split. This permits the inner ring to conform to and follow centrifugally induced expansions of the outer load carrying ring. The subject invention offers an alternative approach to that taught by Grant.

SUMMARY OF THE INVENTION

This invention affords a dimensionally stable, two piece channel for separating particulates, suspended in a fluid medium, according to their effective masses. This is accomplished by providing a channel in which virtually all bending moments are significantly reduced. The channel is annular, cylindrical, has a cylinder axis and is mounted in an apparatus that includes means for rotating the channel about the axis, means for passing the fluid medium circumferentially through the channel, and means for introducing the particulates into the medium for passage through the channel. This channel is improved according to this invention by constructing it to have an outer support ring and a continuous inner channel ring mating with the support ring to define the channel. The channel ring is selected to have a low tension modulus capable of following the centrifugally induced expansion of the support ring without causing excessive stress in the channel ring. Means are provided to load the channel ring such that it is forced to expand to follow centrifugally induced expansions of the support ring.

In accordance with one embodiment of the invention the channel ring is constructed of an elastomeric plastic capable of providing a liquid tight seal against the support ring. The annular thickness of the support ring is selected to permit minimal radial expansion under centrifugal force. In one embodiment, the channel ring is loaded with particles of high density to permit the channel ring to follow the centrifugally induced expansions of the support ring.

Alternatively, the channel ring is loaded with sector-like segments mounted on the inner circumferential surface of the channel ring. Each segment is U-shaped in radial cross section so as to define a circumferential slot adapted to aid radial expansion of the channel ring under centrifugal force. When this construction is used, circumferential grooves are formed in the support ring on its radially inner surface to receive the ends of the U-shaped segments. The axially central portion of the segments is weighted to produce an axial bulge in the channel ring that conforms to the axial deformation of the support ring caused by the circumferential grooves under the influence of centrifugal force, thereby maintaining the thickness of the channel relatively constant. Preferably the support ring and channel ring are supported by a pair of axially spaced compression washers mounted on the rotor hub for maintaining the support ring and channel ring statically loaded and dynamically supported during centrifugal operation.

With this particular construction, the SFFF channel is dimensionally stable. This is true because its unique design has eliminated all bending moments which support the channel and permitted two elements, the support and channel rings, which are essentially hoops, to operate radially in unison. That is, the inner channel ring is able to follow the expansions of the support ring and yet maintain sealing contact with the support ring inner wall, thereby to form the channel. Because the channel is constructed of two mating inner and outer rings, it is possible to construct the channel accurately and to have smooth inner surfaces. Further, cleaning of the channel is facilitated since the rings may be separated for such purpose.

BRIEF DESCRIPTION OF THE DRAWINGS

Further advantages and features of this invention will become apparent from the following description wherein.

DETAILED DESCRIPTION OF THE PREFERRED EMBODIMENT

Figures 1, 2:
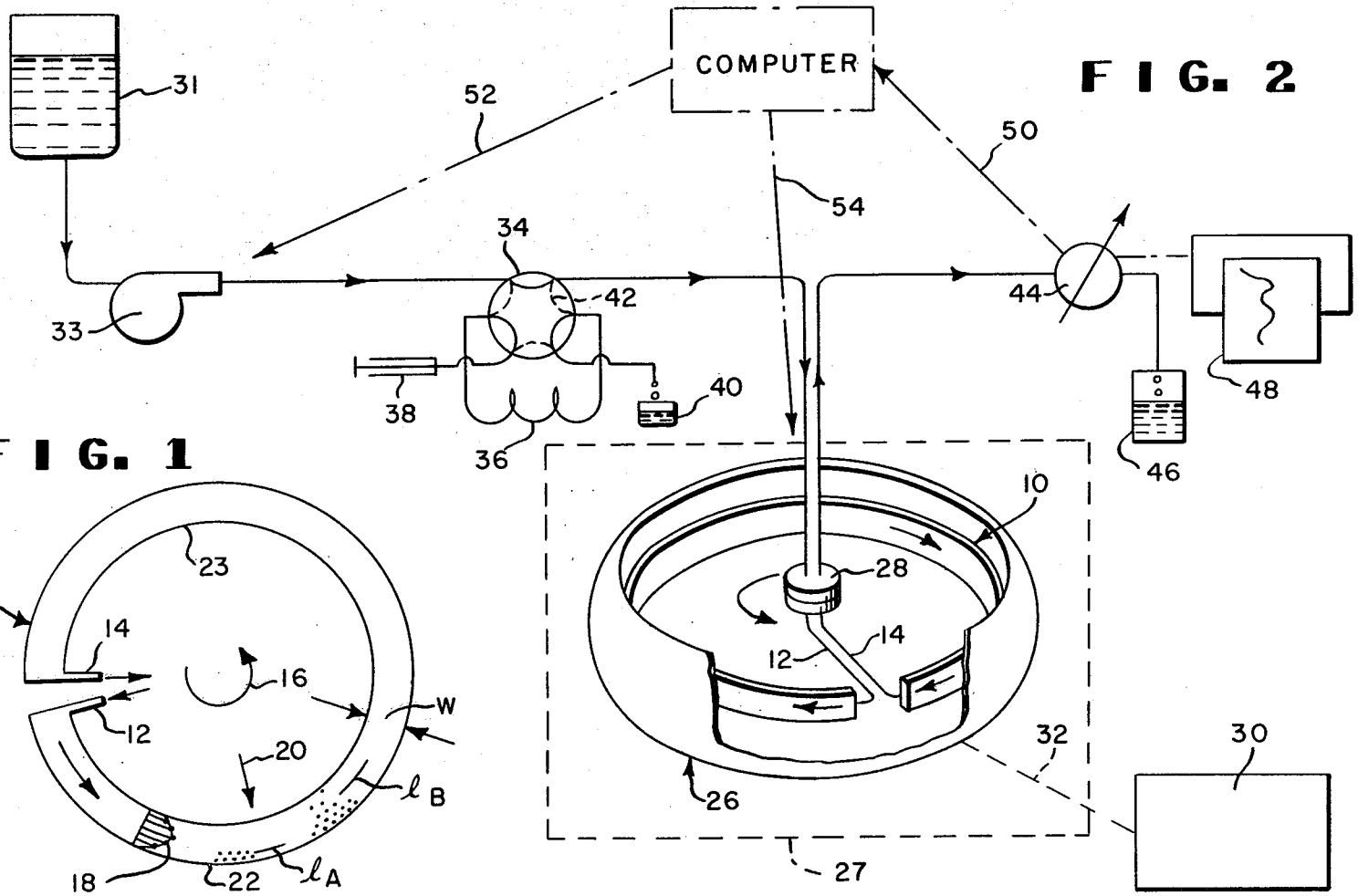
FIG. 1 is a simplified schematic representation of a sedimentation field flow fractionation technique.
FIG. 2 is a partially schematic, partially pictorial representation of an SFFF apparatus constructed in accordance with this invention.

The principles of operation of a typical SFFF apparatus with which this invention finds use may perhaps be more easily understood with reference to FIGS. 1 and 2. In FIG. 1 there may be seen an annular ringlike (even ribbonlike) channel 10 having a relatively small thickness (in the radial dimension) designated W. The channel has an inlet 12 in which the mobile phase or liquid is introduced together with, at some point in time, a small sample containing a particulate to be fractionated, and an outlet 14. The annular channel is spun in either direction. For purposes of illustration the channel is illustrated as being rotated in a counterclockwise direction denoted by the arrow 16. Typically these channels may be in the order of magnitude of 0.025 cm; actually, the smaller the channel thickness, the greater rate at which separations can be achieved and the greater the resolution of the separations.

The channel 10 is defined by an outer surface or wall 22 and an inner surface or wall 23. If now a radial centrifugal force field F, denoted by the arrow 20, is impressed transversely, that is at right angles to the channel, particulates are compressed into a dynamic cloud with an exponential concentration profile, whose average height or distance from the outer wall 22 is determined by the equilibrium between the average force exerted on each particulate by the field F and by the normal opposing diffusion forces due to Brownian motion. Because the particulates are in constant motion at any given moment, any given particulate can be found at any distance from the wall. Over a long period of time compared to the diffusion time, every particulate in the cloud will have been at every different height from the wall many times. However, the average height from the wall of all of the individual particulates of a given mass over that time period will be the same. Thus, the average height of the particulates from the wall will depend on the mass of the particulates, larger particulates having an average height $1_A$ (FIG. 1) that is less than that of smaller particulates $1_B$ (FIG. 1).

If one now causes the fluid in the channel to flow at a uniform speed, there is established a parabolic profile of flow 18. In this laminar flow situation, the closer a liquid layer is to the wall, the slower it flows. During the interaction of the compressed cloud of particulates with the flowing fluid, the sufficiently large particulates will interact with layers of fluid whose average speed will be less than the maximum for the entire liquid flow in the channel. These particulates then can be said to be retained or retarded by the field or to show a delayed elution in the field. This mechanism is described by Berg and Purcell in their article entitled "A Method For Separating According to Mass a Mixture of Macromolecules or Small Particles Suspended in a Fluid," I-Theory, by Howard C. Berg and Edward M. Purcell, Proceedings of the National Academy of Sciences, Vol. 58, No. 3, pages 862–869, September 1967.

In accordance with this invention, a channel for SFFF having dimensional stability is achieved by reducing bending moments in the channel structure itself. This is accomplished by using a radially unrestricted support ring. The outer radius of the support ring is calculated to minimize radial expansion of the support ring under the combined body force of elements forming the channel and the centrifugally induced hydraulic pressure of the fluid medium in the flow channel. An inner or channel ring, mating with the inner radial surface of the support ring, is selected to have a tensile modulus such that it is permitted to follow the radial expansion of the support ring without causing undue stress in the channel ring. The channel ring is also selected of such a material that it is capable, with a groove formed in its outer peripheral surface, of mating with the support ring and thereby form the channel.

The channel ring is weight loaded to permit it to follow the expansions of the support ring. Weight loading, in accordance with this invention may be accomplished by several techniques. One technique includes applying fluid pressure on the inner radius of the channel ring to provide the force needed to follow such radial expansions. This may be accomplished by forming toroidal bladder, placing the bladder on the inside radial surface of the channel ring, and filling the bladder with a suitable fluid. Alternatively, the channel ring may be formed of an elastomeric material having the desired modulus, but molded with embedded particles of a relatively high density to provide the necessary weight.

In the preferred embodiment of the invention, however, the channel ring is weight loaded with separate sector-like segments which may be used to provide the necessary expansion of the channel ring. Both the channel ring and support ring are mounted on the hub of the rotor by compression washers which statically load the channel ring and the support ring and thereby follow the radial expansion of the two mating rings.

Figure 3:
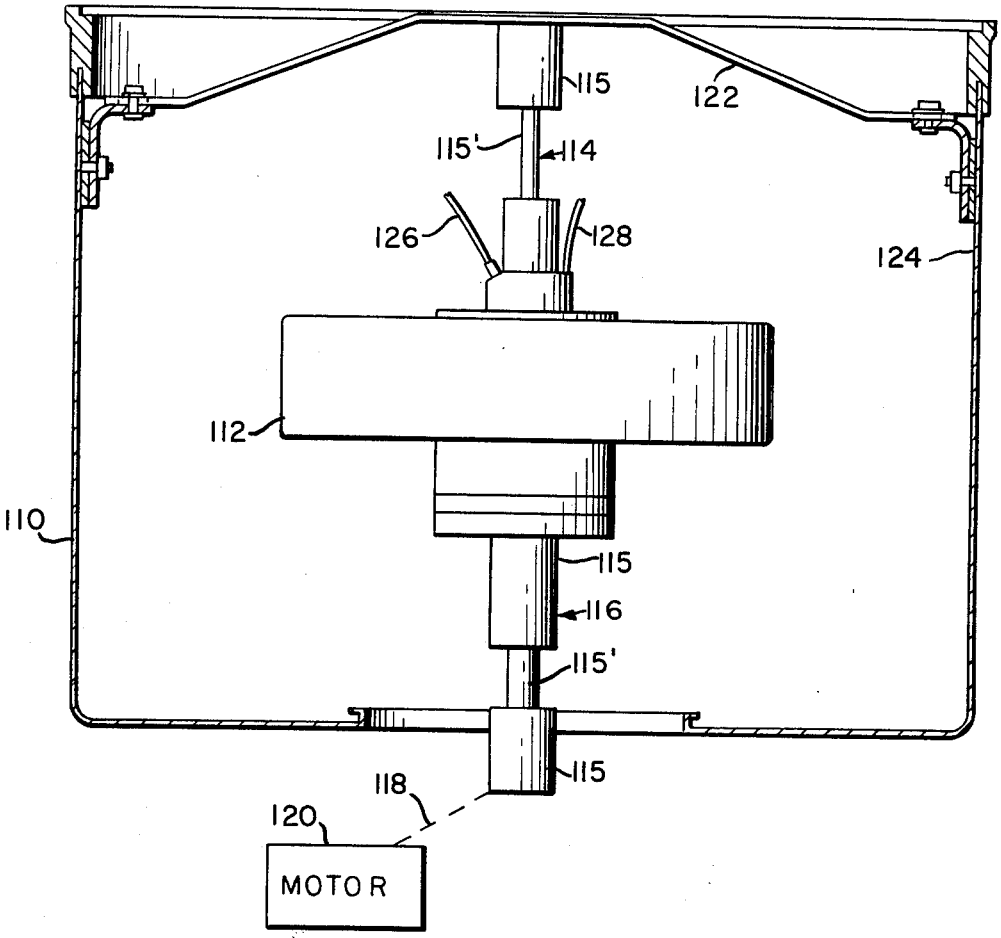
FIG. 3 is a cross-sectional elevation view of an SFFF rotor constructed in accordance with this invention.

With reference to FIG. 3 there is seen a centrifuge constructed with the rotor of this invention. The centrifuge includes a housing or chamber 110 for housing an SFFF type rotor 112 supported by upper and lower flexible couplings 114 and 116, respectively. The preferred flexible shaft couplings may be Heli-cal TM rotating shaft flexible couplings sold by Helical Products Company, Inc. Each coupling consists of a pair of flexible helical elements 115 connected by a rigid shaft 115'. Each element 115 is one in which the helical flexible configuration is a curved beam. The curved beam is made by developing a helical groove around the outside diameter of a cylinder leaving a web which resembles a knife blade wrapped edgewise around an axial wire. This form of coupling permits maximum torsional rigidity and torque capacity. Although the Heli-cal TM flexible coupling is preferred, other known flexible shaft couplings may be used as desired. In fact, any flexible coupling may be used.

The lower flexible coupling 116 is rotating and is coupled through a suitable linkage, which may be gears or a belt drive, depicted by the dashed line 118, to a suitable prime mover such as a motor 120. The upper flexible coupling 114 is nonrotating and is secured by a mechanical support 122 to the sides 124 of the chamber 110 by any suitable means. Conduits 126 for transmitting fluids to the rotor are coupled to the hub of the rotor which includes a rotating seal (not shown in FIG. 3). A separate conduit 128 is connected to a source of cooling water for cooling the bearings and hence reducing heating of the rotating seal. Such heating is undesirable particularly when using biological materials. In each instance the conduits 126 and 128 are shown singularly for clarity of illustration. In actual practice two conduits 128 are required to provide water to and from the system and two or three conduits 126 are used for the rotor, depending upon the particular system used. In SFFF, typically three conduits are used.

Figure 4:
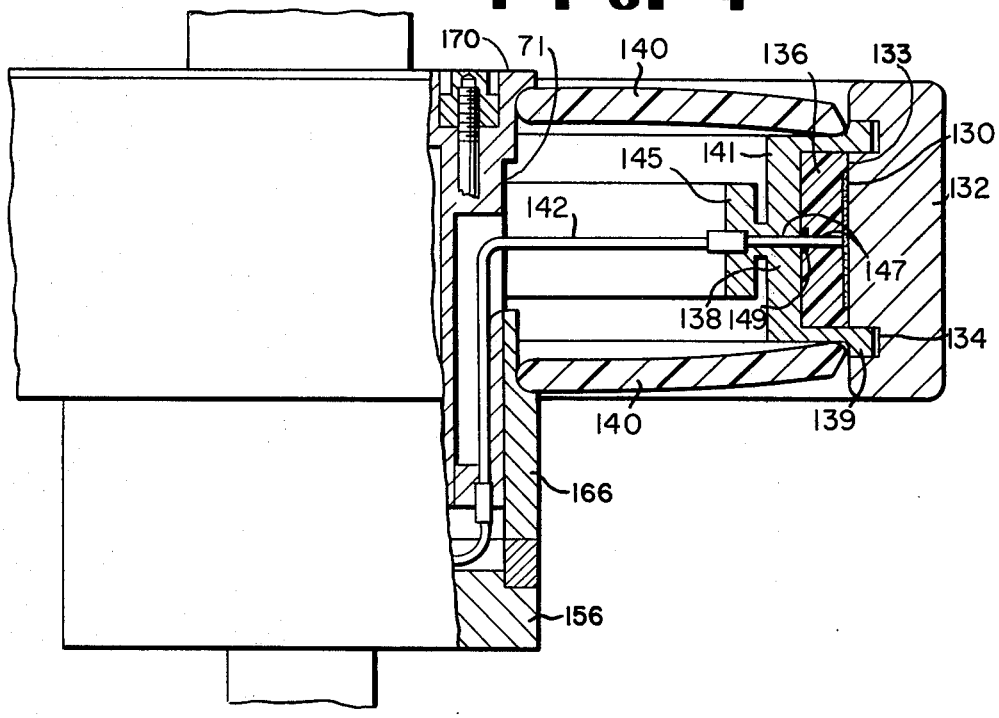
FIG. 4 is a fragmentary elevation view, partially cut away, showing the details of a field flow fractionation channel constructed in accordance with this invention.

Although any type of rotating seal may be used to couple fluids to and from the flow channel 130, the rotating seal described in the Romanauskas application entitled "Rotating Seal for Centrifuges" is preferred. Alternatively, the rotating seal described in an application Ser. No. 125,854, filed Feb. 29, 1980, entitled "Drive for Rotating Seal," by Charles Heritage Dilks, Jr., may be used. Whatever the rotating seal used, the conduits 142 transmit the fluids from the rotating seal in the rotor hub 170 to the annular channel 130 (FIG. 4). As has been described, rotors for SFFF have an annular ring-like (alternatively, belt-like or ribbon-like) flow channel 130 having a relatively small thickness (the radial dimension).

The channel 130 is defined by a groove formed in the outer peripheral surface of a resilient inner ring 136 formed out of a suitable chemically inert, strong, yet resilient material such as polytetrafluoroethylene. Alternatively, materials such as polyethylene, polyurethane or nylon may be used. The lands 133 remaining on either side of the groove are maintained in contact with the inner surface of the outer support ring 132, to maintain a leak-free channel 130, by loaded ring segments 138. These segments 138 are U-shaped in cross section with the ends of the U engaging circumferential grooves 134 formed in the radially inner surface of the support ring 132, thus forming a load ring. The support ring may be formed of a suitable material having a high tensile strength as is typically used in centrifuges such as titanium, stainless steel or aluminum. In this manner, as the outer or support ring 132 expands under the influence of centrifugal force, the inner or channel ring 136 is forced by the segments 138 to expand a like amount to maintain contact between the rings.

The flow channel 130 is maintained intact when the rotor is at rest, and is mounted for rotation about the axis of the drive system, by a pair of compression washers 140 which are annular in configuration. Each washer is generally convex in cross section and springy so as to force the segments 138 of the load ring radially outward toward the support ring 132, thus maintaining the channel ring 136, which defines the channel 130, in constant compression against the support ring 132. Fluids are conducted to and from the channel 130 as by the conduits 142 (only a single conduit being shown) within the confines of the rotor 112 through the rotating seal.

Figure 5:
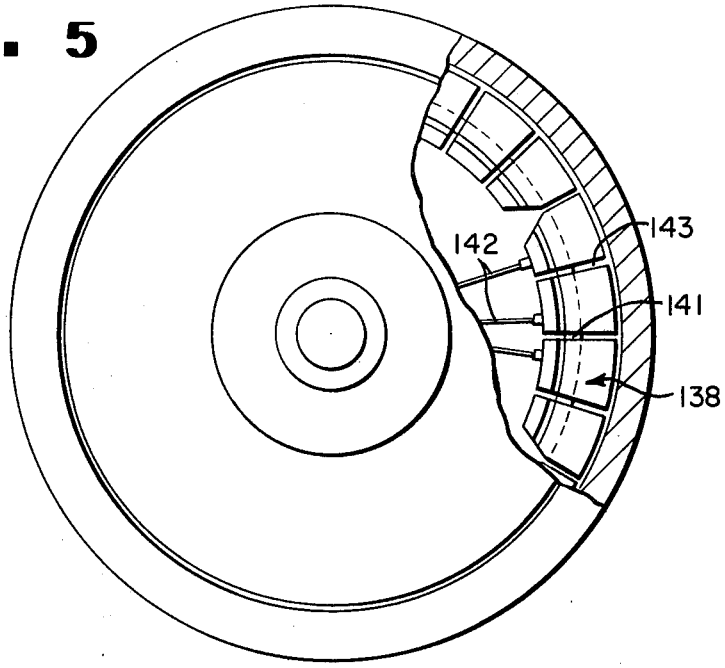
FIG. 5 is a plan view of the field flow fractionation channel of FIG. 4, partially cut away.

The load ring segments 138, which together form the load ring, as seen most clearly in FIG. 5, are separate arcuate shaped sectors or elements having the U-shaped cross section with the ends 139 of the U being slidingly positioned in the grooves 134. The bottom of the U, designated by the numeral 141, constitutes the continuous connecting element of each U-shaped segment 138 with the remaining portions of the U cut away as seen at 143 to permit some flexing of the segments 138. In this manner, the segments 138 accommodate the expansion and contraction of the channel ring 136. These flexing slots or cuts 143 are seen most clearly in FIG. 5 and extend through the uprights of the U.

In accordance with this invention, the bottom of the U-shaped sectors 138 are formed to have a T-shaped cross section 145. The particular mass provided by the T-shaped cross section 145 is that required to provide the necessary weight loading for the load ring as described hereinbefore. This loading, as will be recalled, is that necessary to cause the bowing along the rotor axis, i.e., the thickness of the flow channel, to correlate with the bowing of the support ring 132.

Each sector 138 as well as the channel ring 136 has bores 147 therein to permit the fluid in the conduit 142 to communicate with the channel 132. A suitable screw coupling couples the conduit 142 to the bores 147. O-ring seals 149 may provide an appropriate seal between the segments 138 and the channel ring 136. The compression washers 140, as previously described, statically load the channel ring and support both the support ring and the channel ring for suitable rotation about the rotor hub 170. The compression washers 140 are mounted on the rotor hub 170 at the top and on a spring loading ring 166 secured to the base 156 of the rotor hub.

In this manner the channel 130 is completely isolated from the rotor hub except for the static loading and support provided by the compression washers and is essentially free from all bending moments caused by the mounting. This provides the required dimensional stability for the channel during operation even under relatively extreme centrifugal forces.

For the sake of a complete disclosure, the rotor of this invention may be used in the system depicted in FIG. 2. The inlet fluid (or liquid) or mobile phase of the system is derived from suitable solvent reservoirs 30 which are coupled through a conventional pump 32 thence through a two-way, 6-port sampling valve 34 of conventional design through a rotating seal 28, also of conventional design, to the inlet 12.

Samples whose particulates are to be separated are introduced into the flowing fluid stream by this conventional sampling valve 34 in which a sample loop 36 has either end connected to opposite ports of the valve 34 with a syringe 38 being coupled to an adjoining port. An exhaust receptacle 40 is coupled to the final port. When the sampling valve 34 is in the position illustrated by the solid lines, sample fluid may be introduced into the sample loop 36 with sample flowing through the sample loop to the exhaust receptacle 40. Fluid from the solvent reservoirs 30 in the meantime flows directly through the sample valve 34. When the sample valve 34 is changed to a second position, depicted by the dashed lines 42, the ports move one position such that the fluid stream from the reservoir 30 now flows through the sample loop 36 before flowing to the rotating seal 28. Conversely the syringe 38 is coupled directly to the exhaust reservoir 40. Thus the sample is carried by the fluid stream to the rotating seal 28.

The outlet line 14 from the channel 10 is coupled through the rotating seal 28 through the channel 10, out through the rotating seal 28 to a conventional detector 44 and thence to an exhaust or collector receptacle 46. The detector may be any of the conventional types, such as an ultraviolet absorption or a light scattering detector. In any event, the analog electrical output of this detector may be connected as desired to a suitable recorder 48 of known type and in addition may be connected as denoted by the dashed line 50 to a suitable computer for analyzing this data. At the same time this system may be automated, if desired, by allowing the computer to control the operation of the pump 32 and also the operation of the centrifuge 28. Such control is depicted by the dashed lines 52 and 54, respectively.

By way of example, a rotor for SFFF that has been constructed in accordance with this invention was constructed with a support cylinder formed of 6AL-4V Ti having an outer outside radius of 5.200 inches (13.2 cm) and an inside radius of 4.410 inches (11.2 cm) which, of course, is the radius of the channel 130. The channel elastomeric material 136 was constructed of nylon 6. Under these conditions with a centrifugal force of 50,000 times normal gravity, the support ring undergoes a radial displacement of 0.0171 inches (0.0434 cm) which is readily followed by the channel ring. To permit such following to take place the sectors were constructed to provide a loading of 11040 pounds/circumferential inch at 20,000 rpm (1973 kg/circumferential cm) and the T portion 145 was constructed to provide a center loading such as to cause it to bow 0.00025 inches (0.000635 cm) at 20,000 rpm.

I claim:

1. In an apparatus for separating particulates suspended in a fluid medium according to their effective masses, said apparatus having an annular cylindrical channel with a cylinder axis, means for rotating said channel about said axis, means for passing said fluid medium circumferentially through said channel, and means for introducing said particulates into said medium for passage through said channel, the improvement wherein:

said channel comprises an outer support ring and a continuous inner channel ring mating with said support ring to define said channel, said channel ring having a tension modulus capable of following centrifugally induced expansions of said support ring, and means to load said channel ring to follow said expansion.

2. An apparatus according to claim 1 wherein said channel ring is constructed of an elastomeric material capable of providing a liquid tight seal against said support ring.

3. An apparatus according to claim 1 or 2 wherein the annular thickness of said support ring is selected to permit minimal radial expansion under centrifugal force.

4. An apparatus according to claim 1 and 2 wherein said channel ring is loaded with embedded particles of higher density than the density of said channel ring.

5. An apparatus according to claim 1 or 2 wherein said channel ring is loaded by sector segments mounted on the inner circumferential surface of said channel ring.

6. An apparatus according to claim 5 wherein each said segment is U-shaped in radial cross section, thereby defining a circumferential slot adapted to enclose and prevent axial expansion of said channel ring.

7. An apparatus according to claim 6 wherein said support ring defines circumferential grooves on its radially inner surface adapted to slidingly receive the ends of said U-shaped segments.

8. An apparatus according to claim 7 wherein the axially central portions of said segments is loaded to produce an axial bulge of said channel ring conforming to the axial deformation of said support ring caused by said grooves under centrifugal force.

9. An apparatus according to claim 5 which includes a pair of axially spaced compression washers for supporting said support ring for rotation and statically loading said channel ring against said support ring.

10. An apparatus according to claim 1 or 2 which includes a pair of axially spaced compression washers for supporting said support ring for rotation and statically loading said channel ring against said support ring.

* * * * *